US005084921A

United States Patent [19]

Hicks, Jr.

[11] Patent Number: 5,084,921

[45] Date of Patent: Feb. 4, 1992

[54] SUPINE PATIENT LIFT AND TRANSFER APPARATUS

[76] Inventor: George W. Hicks, Jr., 1401 NE. 70th, Oklahoma City, Okla. 73111

[21] Appl. No.: 642,949

[22] Filed: Jan. 18, 1991

[51] Int. Cl.[5] ..... A61G 7/08

[52] U.S. Cl. ..... 5/81.1; 5/86.1; 5/88.1

[58] Field of Search ..... 5/81 R, 86, 81 C, 89, 5/88

[56] References Cited

U.S. PATENT DOCUMENTS

| | | | |
|---|---|---|---|
| 1,487,150 | 3/1924 | Deakins | 5/88 |
| 2,439,066 | 4/1948 | Vanderlyn et al. | 5/88 |
| 2,565,761 | 8/1951 | Dean | 5/86 |
| 2,595,651 | 5/1952 | Feist | 5/86 |
| 3,859,677 | 1/1975 | Nordwig | 5/89 |
| 3,924,281 | 12/1975 | Gibbs | 5/81 R |
| 4,195,375 | 4/1980 | Paul | 5/86 X |
| 4,569,094 | 2/1986 | Hart et al. | 5/81 R |
| 4,649,581 | 3/1987 | Lee, Jr. | 5/86 X |
| 4,748,701 | 6/1988 | Marlowe et al. | 5/89 |

FOREIGN PATENT DOCUMENTS

| | | | |
|---|---|---|---|
| 2507471 | 12/1982 | France | 5/81 R |

*Primary Examiner*—Gary L. Smith
*Assistant Examiner*—Michael J. Milano
*Attorney, Agent, or Firm*—Robert K. Rhea

[57] ABSTRACT

An apparatus for lifting, lowering and transferring a bed patient between supine and sitting positions is formed by a mobile frame supporting an upright standard pivotally supporting manually moved patient sling lifting arms. Manually operated gearboxes on the lift arms angularly rotate a sling shaft connected with respective ends of a patient supporting sling. The lift arms are spring biased upwardly to assist a caretaker in lifting the patient supporting sling.

5 Claims, 2 Drawing Sheets

SUPINE PATIENT LIFT AND TRANSFER APPARATUS

BACKGROUND OF THE INVENTION

1. Field of the invention.

This invention relates to bed patient care and more particularly to a lifting device for moving a patient in a supine position and/or lowering him to a sitting position in a chair.

Bed patients who are not capable of moving themselves, even while in bed, pose a problem for nursing care personnel. This is particularly true when the bed patient, who mostly remains in a supine position and is of large frame and possibly obese.

This invention is intended for use with such patients in which the nurse may single-handedly lift and transfer a bed patient from one bed to another or to a chair and return them to the bed.

2. Description of the prior art.

It has been common practice to use a portable crane for lifting and moving a bed patient in hospital wards, or the like. One such crane is briefly described in U.S. Pat. No. 4,748,701 which utilizes a fabric sling placed under a patient to lift a patient in a sitting position for transfer to a chair or the like.

This invention is distinctive over this and other patient handling devices by providing a mobile base mounted standard having opposing vertically pivoting spring biased arms which lifts a patient supporting sling for moving the patient either horizontally or in a sitting position.

SUMMARY OF THE INVENTION

A caster wheel equipped U-shaped horizontal frame, dimensioned to be easily disposed between and under adjacent beds having a patient to be moved is provided with an upright standard projecting upwardly above the height of a conventional hospital bed a selected distance. The upper end portion of the standard is bifurcated and diametrically spans a support disk. A pair of endless guide rods diametrically disposed on opposing sides of the standard are rigidly connected therewith to form semi-annular spaces between the rods circumferentially spaced outwardly of the disk periphery on opposite sides of the standard.

A pair of support arms, bifurcated at one end, straddle the disk on opposite sides of the standard and are pivotally connected adjacent their bifurcated ends to the disk. The other end portions of the arms project longitudinally in opposing directions and are vertically pivotable about their horizontal connection with the disk within the spacing between the pair of guide rods.

Pairs of springs respectively surround the rods on opposing sides of their lowermost connection with the standard and respectively bear against a transverse arm support slidably enveloping intermediate portions of the rods beneath the respective support arm.

The free end portion of each support arm is provided with a gearbox inturn horizontally supporting a sling shaft in a wind-up and pay-out fashion of the respective end portions of a patient sling when connected by its respective end portion with the respective sling shaft.

The principal object of this invention is to provide an apparatus permitting a lone operator to lift and transfer patients from a supine to a sitting position and vice versa.

DESCRIPTION OF THE PREFERRED EMBODIMENTS

Figure 1:
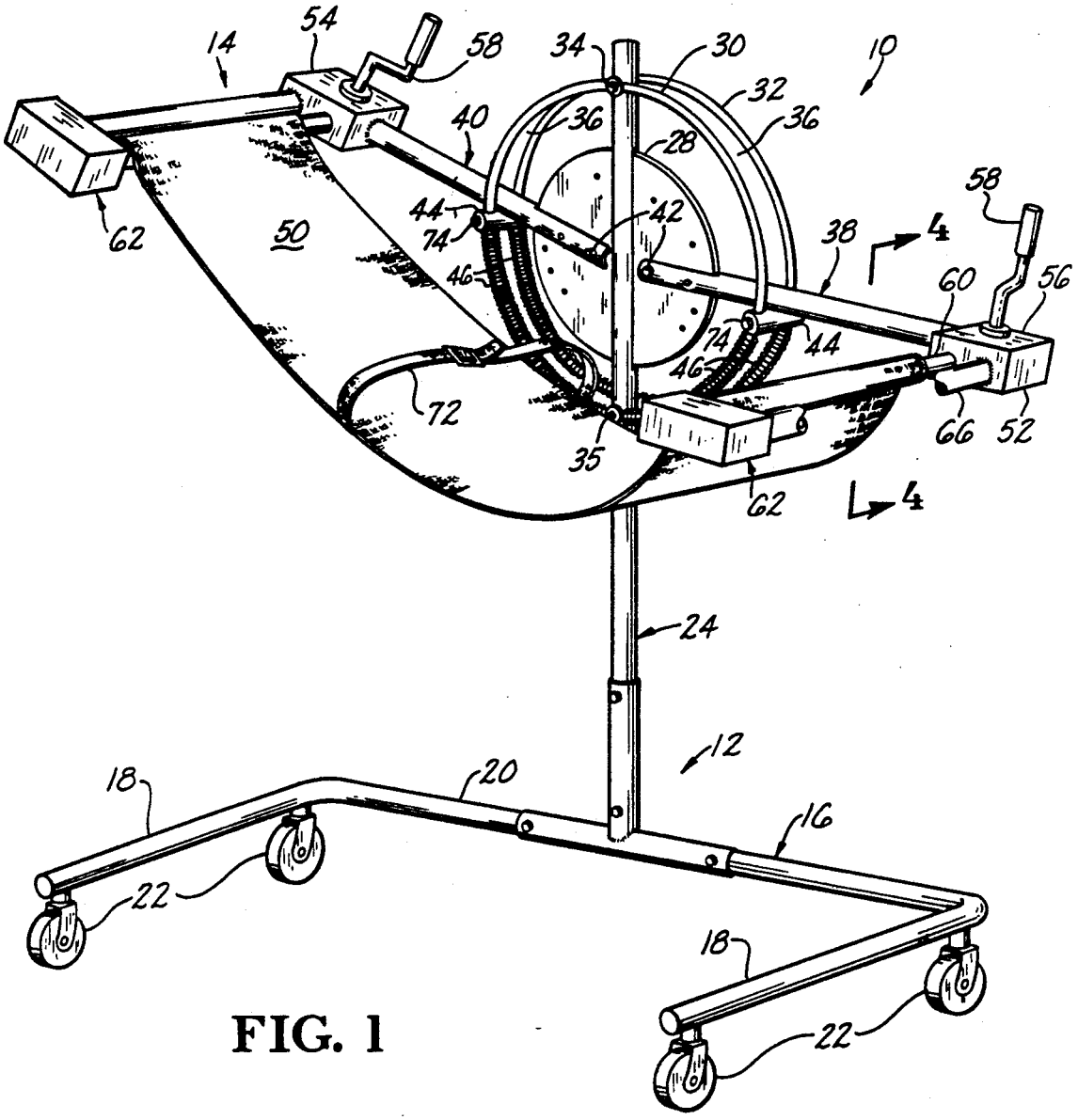
FIG. 1 is a fragmentary perspective view of the apparatus in operative position.

Like characters of reference designate like parts in those figures of the drawings in which they occur.

In the drawings:

The reference numeral 10 indicates the device as a whole comprising a frame means 12 having a patient lift and support means 14 supported by the frame means.

Figure 3:
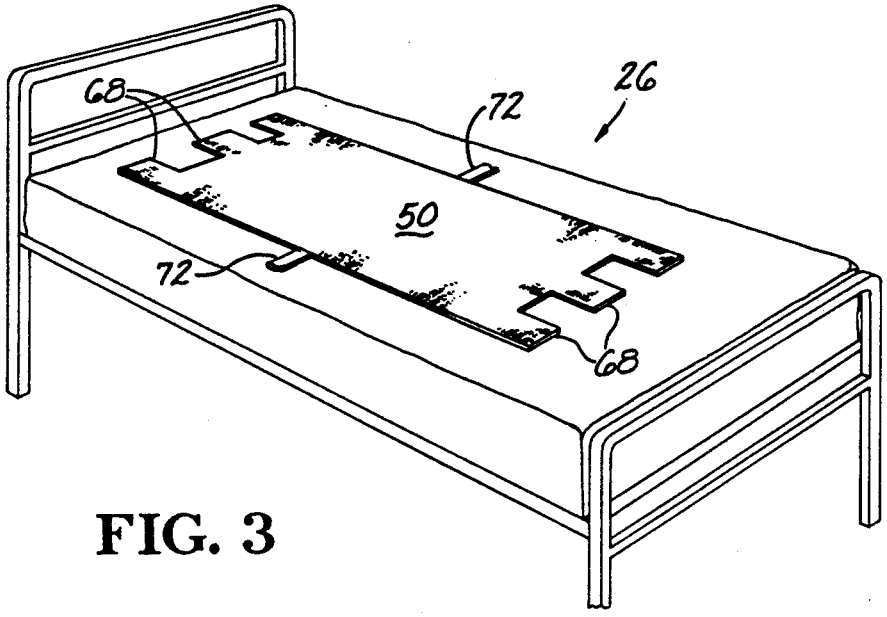
FIG. 3 is a fragmentary perspective view of a standard patient bed having a patient sling thereon; and, FIG. 4 is a fragmentary vertical cross sectional view, to an enlarged scale, partially in elevation, taken substantially along the line 4—4 of FIG. 1.

The frame means comprises a horizontally disposed U-shaped base frame 16 having parallel legs 18 of a selected length normal to its bight portion 20. The frame 16 is supported by a plurality of caster wheels 22. Medially its length, the bight portion 20 is provided with an upright standard 24 projecting upwardly a selected distance above the height of a patient's bed (FIG. 3). The bed 26 forms no part of the invention other an to set forth its relation to the device 10 as will be presently apparent.

The upper end portion of the standard 24 is diametrically bifurcated parallel with the longitudinal axis of the frame bight portion 20 and diametrically spans and is rigidly connected with a planar circular disk 28.

A pair of endless rods 30 and 32 diametrically substantially greater than the outside diameter of the disk 28 are disposed on opposing sides of the standard 24 substantially coaxial with respect to the disk 28 and are secured to the standard above and below the perimeter of the disk 28 by pins or bolts 34 and 35, respectively.

The rods 30 and 32 thus forming an annular space 36 extending through substantially 180° on opposite sides of the standard 24 in a vertical plane taken through the longitudinal axis of the frame bight portion 20.

A pair of support arms 38 and 40, each have one end portion diametrically bifurcated and spanning a radial portion of the disk 28 on opposing sides of the standard 24 and are pivotally secured to the disk by pins or bolts 42 for vertical pivoting action of the other end portions of the support arms about the horizontal axes of the pins 42 for the purposes presently apparent.

A pair of cylindrical, diametrically slotted intermediate their ends, arm rests 44 transversely surround and are slidable respectively, along the pair of rods 30 and 32 on opposing sides of the standard.

The arm rests 44 underlie the respective arm 38 and 40 and are biased against the respective support arm by pairs of helical springs 46 respectively surrounding the rods 30 and 32 and interposed between the respective arm rest 44 and the pin 35 connecting the rods 30 and 32 to the standard.

The purpose of the springs 46 is to bias the support arms 38 and 40 in an upward direction to support a patient when lying on and supported by a web-type sling 50 supported by the arms 38 and 40 as will now be explained.

Gearbox means 52 and 54 is connected with each end of the support arms 38 and 40 opposite their pivotal connection with the disk 28.

In the interest of brevity, only the gearbox means 52 is described in detail.

The gearbox means comprises a gear case 56 journaling a worm gear, not shown, angularly rotated manually by a handle 58 projecting outwardly of the gearbox 56.

A sling shaft 60 journaled at one end portion by the gearbox, including a cooperating gear meshing with and driven by the worm gear within the gearbox 56, projects horizontally from the gear box 56, normal to the longitudinal axis of the support arm 38, a selected distance, preferably sufficient to substantially span the transverse dimension of the bed 26 when disposed thereover. The other end of the sling shaft 60 is provided with a bearing support box 62 secured to one end portion of a brace shaft 66, parallel with the sling shaft 60 and having its opposite end portion rigidly connected with the gearbox 56.

Figure 4:
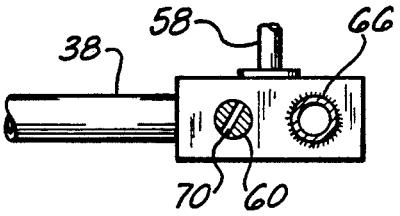

As clearly shown by FIG. 3, the patient sling 50, rectangular in general configuration, is provided at its respective end portions with a plurality of longitudinally extending strap-like sections 68 which are cooperatively received within slots 70 (FIG. 4) formed in longitudinally spaced relation in the sling shaft 60.

The straps 68 are provided with self-adhering material, not shown, such as that presently marketed under the trademark Velcro for securing the straps to the respective sling shaft 60 and insuring a wind-up action of the respective end portions of the sling on the respective sling shaft for supporting a patient.

The sling 50 is preferably provided with at least one transverse buckle-equipped strap 72, or the like, to secure a patient in place on the sling when positioned thereon and lifted by the device 10.

OPERATION

Figure 2:
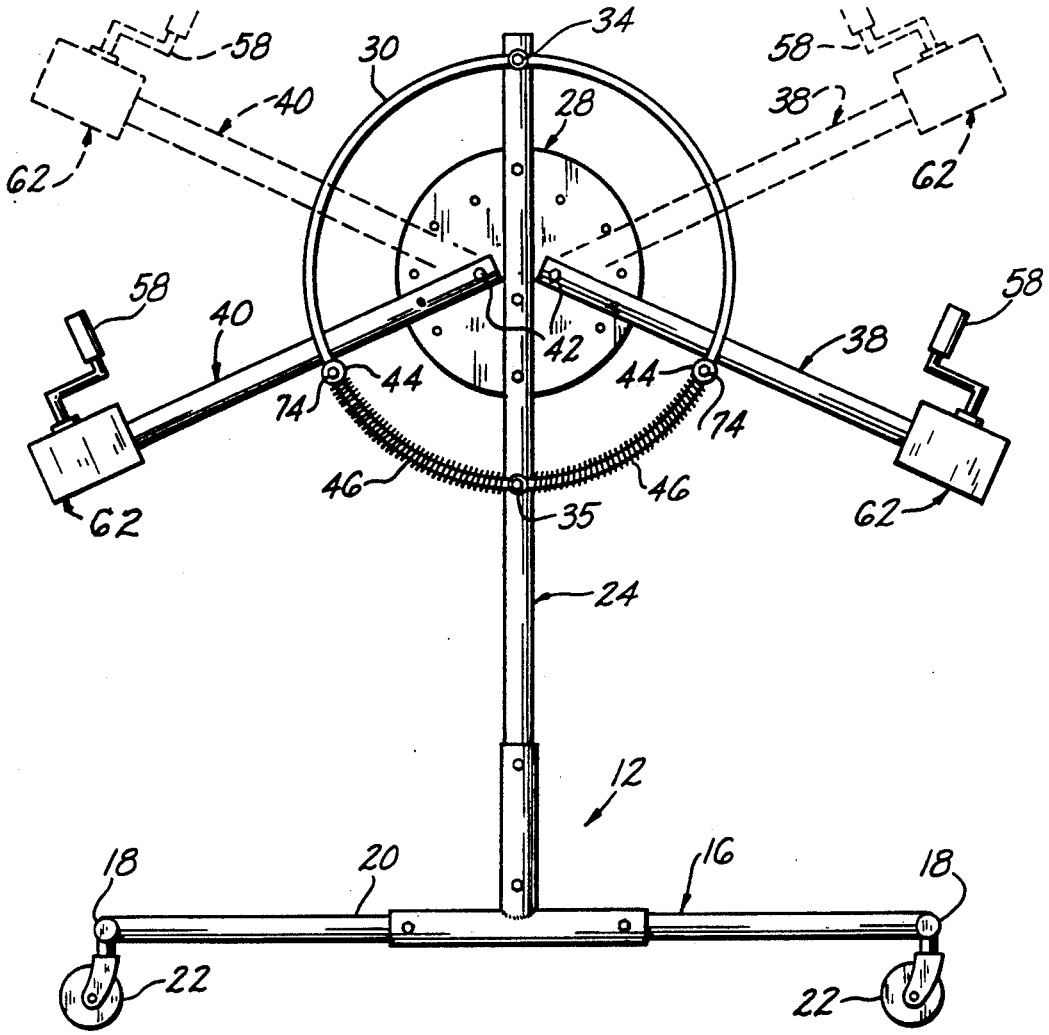
FIG. 2 is a front elevational view illustrating, by dotted lines, the vertical pivoting action of its sling and patient supporting arms.

In operation, the device 10 is assembled substantially as described hereinabove and illustrated by FIG. 2. With the sling 50 underlying a patient, not shown, supine on the bed 26 the device 10 is manually moved in a mobile manner to position it at one side of the bed 26 with the frame legs 18 projecting under the bed and the bight portion 20 of the frame parallel with the adjacent edge of the bed.

The arms 38 and 40 are manually moved downwardly, one at a time, against the lifting force of the springs 46 to the plane of the upper surface of the bed and the sling straps 68 are inserted into the respective sling shaft slot 70 and by the handle 58, manually wound angularly on the sling shaft.

Obviously, the depending portion of the standard 24 may comprise a hydraulic cylinder to initially elevate and lower the patient lift and support means 14.

The retaining strap 72 is secured around the torso of the patient and if two persons are operating the device 10 they each manually rotate the gearbox cranks 58 to lift the patient off the upper surface of the bed by releasing the pressure previously placed on the support arms 38 and 40 allowing the torsion of the springs 46 to assist in such lifting action of the patient.

To firmly support a patient, a set screw 74 in one end of each arm rest 44 is tightened against the adjacent endless rod 30 to hold the arm rest in a selected position.

If a patient is simply being transferred to another bed or location the device with the patient on the sling may be moved to position its frame 16 outwardly from under the bed 26 and then moved by the caster wheels to the new location, to be lowered on another bed by reversing the above operation.

If a patient is being moved for comfort of the patient or being placed in a chair and the torso and head portion of the patient is adjacent the support arm 40 with the arm rest set screw 74 released, manual lifting action on the support arm 40 permits a raising or lifting action of the patient's torso and to be maintained in this position by the arm rest set screw 74 being reengaged with the endless ring 30.

Similarly, manual downward pressure on the support arm 38 moves the patient's feet and leg portions downwardly against the resistance of the springs 46 which are maintained in a lowered position and the patient in a sitting position in the hammock-like sling by retightening the arm rest set screw 74 against the endless rod 30.

In this position the crank handles 58 may be angularly rotated in an unwinding action of the sling shafts 60 to lower the patient into a chair or the like when the U-shaped frame 16 is disposed adjacent a chair and the patient aligned with the seat and chair back, not shown.

Obviously the invention is susceptible to changes or alterations without defeating its practicability. Therefore, I do not wish to be confined to the preferred embodiment shown in the drawings and described herein.

I claim:

1. Apparatus for lifting and transporting supine bed patients from and to hospital-type beds or chairs, comprising:

mobile frame means including an upright standard projecting above hospital bed height adjacent and at one side of a bed;

patient sling means including a substantially rectangular section of fabric having slotted end portions defining straps at its respective ends for underlying and projecting beyond the feet and head, respectively, of supine patients; and patient sling lift means including a pair of opposed lift arm means pivotally supported by said standard for assisting a patient caretaker in moving said sling when supporting a patient in selected lifting and lowering actions, said sling lift means further including:

disk means diametrically intersecting the upper end portion of said standard for pivotally supporting the adjacent end of said pair of arms; and, resilient means interposed between said standard and said pair of arms intermediate their respective ends for normally biasing the end portions of said pair of arms opposite their pivotal connection in an upward direction.

2. The apparatus according the claim 1 in which the resilient means includes:

endless ring means including a pair of endless rods secured to said standard above and below said disk in parallel circumferential spaced relation with respect to said disk and on opposing sides of an intermediate portion of said pair of arms;

a pair of arm rests respectively transversely surrounding an intermediate portion of said rods below each arm of said pair of arms; and, a helical spring surrounding each rod of said pair of endless rods between the respective said arm rest and said standard; and, set screw means for normally preventing movement of said arm rests relative to said endless rods.

3. The apparatus according to claim 2 in which the sling lift means further includes:

a gearbox on the end of each arm of said pair of arms opposite the standard; and, sling shaft means cooperatively connected with each said gearbox normal to the longitudinal axis of the respective arm of said pair of arms for winding up and paying out respective end portions of said sling when attached thereto.

4. Apparatus for lifting and transporting supine bed patients from and to hospital-type beds or chairs, comprising:

mobile frame means including an upright standard projecting above hospital bed height adjacent and at one side of a bed;

patient sling means including a substantially rectangular section of fabric having slotted end portions defining straps at its respective ends for underlying and projecting beyond the feet and head, respectively, of supine patients; and, patient sling lift means including a pair of opposed lift arm means pivotally supported by said standard for assisting a patient caretaker in moving said sling when supporting a patient in selected lifting and lowering actions, said sling lift means further including:

a gearbox on the end of each arm of said pair of arms opposite the standard;

sling shaft means cooperatively connected with each said gearbox normal to the longitudinal axis of the respective arm of said pair of arms for winding up and paying out respective end portions of said sling when attached thereto;

disk means diametrically intersecting the upper end portion of said standard for pivotally supporting the adjacent end of said pair of arms; and, resilient means interposed between said standard and said pair of arms intermediate their respective ends for normally biasing the end portions of said pair of arms opposite their pivotal connection in an upward direction.

5. The apparatus according to claim 4 in which the resilient means includes:

endless ring means including a pair of endless rods secured to said standard above and below said disk in parallel circumferential spaced relation with respect to said disk and on opposing sides of an intermediate portion of said pair of arms;

a pair of arm rests respectively transversely surrounding an intermediate portion of said rods below each arm of said pair of arms;

a helical spring surrounding a segment of each rod of said pair of endless rods between the respective said arm rest and said standard; and, set screw means for securing said arm rests to one rod of said pair of endless rods.

* * * * *